US011220795B1

(12) United States Patent
Shea et al.

(10) Patent No.: US 11,220,795 B1
(45) Date of Patent: Jan. 11, 2022

(54) TEMPORARY TAPE REMOVAL MACHINE

(71) Applicants: James P. Shea, Waterford, MI (US); Kevin W. Shea, Metamora, MI (US)

(72) Inventors: James P. Shea, Waterford, MI (US); Kevin W. Shea, Metamora, MI (US)

( * ) Notice: Subject to any disclaimer, the term of this patent is extended or adjusted under 35 U.S.C. 154(b) by 0 days.

(21) Appl. No.: 17/366,690

(22) Filed: Jul. 2, 2021

Related U.S. Application Data

(60) Provisional application No. 63/176,484, filed on Apr. 19, 2021.

(51) Int. Cl.
*E01C 23/08* (2006.01)
*B65H 18/10* (2006.01)
*E01C 23/18* (2006.01)

(52) U.S. Cl.
CPC ..... *E01C 23/08* (2013.01); *B65H 18/10* (2013.01); *E01C 23/185* (2013.01)

(58) Field of Classification Search
CPC ..... E01C 23/08; E01C 23/185; B65H 18/10
See application file for complete search history.

(56) References Cited

U.S. PATENT DOCUMENTS 5,114,268 A * 5/1992 Marcato ..... E01C 23/22 404/101
6,174,104 B1 * 1/2001 Fields ..... E01C 23/08 404/83
6,413,012 B1 * 7/2002 Jones ..... E01C 23/166 239/150
6,619,755 B1 * 9/2003 Christensen ..... E01C 23/08 299/39.2
6,625,964 B2 * 9/2003 McLeod ..... A01B 59/042 172/677
6,830,211 B2 * 12/2004 Sloan ..... B65H 75/242 242/573.1
10,112,794 B1 * 10/2018 Shea ..... E01C 23/08
10,907,313 B1 * 2/2021 Shea ..... E01C 23/08
2014/0064849 A1 * 3/2014 Arnold ..... E01C 23/185 404/75
2017/0312777 A1 * 11/2017 Fontaine ..... B05B 12/002
2018/0274185 A1 * 9/2018 Rutherford ..... E01C 23/088
2020/0157750 A1 * 5/2020 Wilkens ..... E01C 23/185

* cited by examiner

*Primary Examiner* — Abigail A Risic

(57) ABSTRACT

Non-ridable and non-motorized machines for removing temporary tape that include a chassis or frame having front and rear wheels, a vertical support post mounted on the frame or chassis between the front and rear wheels, a horizontal arm mounted on the vertical support post, and a rotatable spool assembly attached to one end of the horizontal arm for winding used temporary tape thereon, wherein the horizontal arm is rotatably coupled to the vertical support to allow the spool assembly to be positioned on either side of the chassis when the horizontal arm is rotated with respect to the vertical support post. The non-ridable temporary tape removal machine can be manually and guided along a pavement during a tape removal operation. The non-motorized temporary tape removal machines can be or coupled to an auxiliary motorized device that pushes the non-motorized temporary tape removal machine during a tape removal operation.

20 Claims, 9 Drawing Sheets

FIG. 2
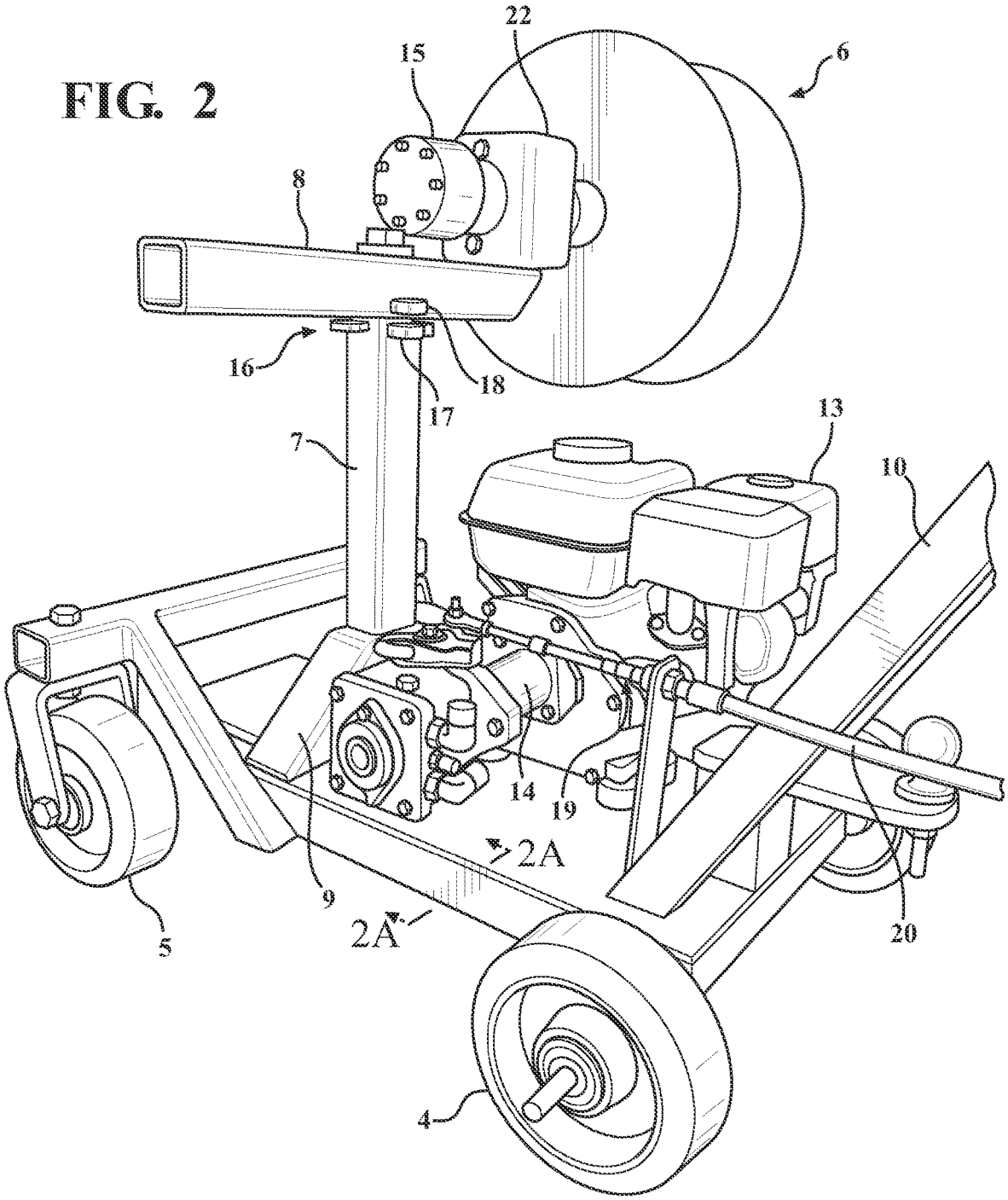
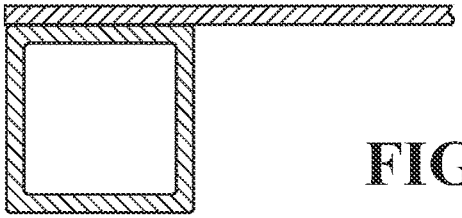
FIG. 2A

TEMPORARY TAPE REMOVAL MACHINE

RELATED APPLICATION

This application is based on U.S. Provisional Application No. 63/176,484, filed Apr. 19, 2021 to which priority is claimed under 35 U.S.C. § 120 and of which the entire specification is hereby expressly incorporated by reference.

BACKGROUND

The present invention relates generally to machines that are designed to remove temporary marking tapes from roads, airport runways, parking lots, bicycle paths and other paved surfaces. More particularly the present invention relates to temporary marking tape removal machines that are designed to be guides and/or pushed by hand or towed or pushed by auxiliary devices. The temporary tape removal machines are non-ridable and can further be non-self-propelled.

Often during the construction, reconstruction, repair or maintenance of paved surfaces mobile or pedestrian travel patterns must be shifted or redirected to allow for uninterrupted and safe movements through such project sites. Before the introduction of removable tapes permanent marking paints/materials were used. Removal of such permanent markings is a slow operation. Among the methods used to remove permanent markings are grinding, milling, shot blasting, sand blasting and water blasting. Each of these removal methods causes undesirable damage to the paved surfaces.

Removable temporary marking tapes were developed in the late 1970's to the early 1980's. The quality of these tapes has improved continually. Initial application of these removable marking tapes was slow and labor intensive. Over time methods of applying these removable tapes have improved lowering the amount of physical labor and time required to apply them.

Removing removable temporary marking tapes has always been a slow and extremely physical process. The labor involved is slow, exhaustive and demoralizing and places workers in hazardous situations. Many injuries have occurred.

The present inventor was granted U.S. Pat. No. 10,112,794 on Oct. 30, 2018 which discloses a Motorized Tape Removal Apparatus (MTRA) that is designed and constructed to safely remove and handle temporary lane marking tape has been removed in a manner that reduces the amount of labor and time it has taken in the past to remove and handle the tape.

U.S. Pat. No. 10,112,794 discloses that the MTRA includes a boom arm that extends outward from the chassis of the MTRA and is movable between up and down and side to side positions relative to the chassis, The upper end of the boom arm supports a spool assembly that includes a rotatable spool upon which used temporary tape removed from a pavement surface is wound for disposal.

The present inventor was recently granted U.S. Pat. No. 10,926,969 on Feb. 23, 2021 on an improved boom arm (also referred to as a roller arm assembly) for a MTRA that allows for easily locating the spool assembly on either side of the MTRA or in a forward position for transportation.

The present inventor has also been granted U.S. Pat. No. 10,907,313 on Feb. 2, 2021 and filed U.S. Non-provisional patent application Ser. No. 17/094,898 which are both directed to temporary tape removal hubs for use with an MTRA.

The entire disclosures of U.S. Pat. Nos. 10,112,794; 10,926,969; and 10,907,313 and U.S. Non-provisional patent application Ser. No. 17/094,898 are expressly incorporated herein by reference.

The present invention is directed to temporary marking tape removal machines that are designed to be guided and/or pushed by hand or towed or pushed by auxiliary devices.

BRIEF SUMMARY

According to various features, characteristics and embodiments of the present invention which will become apparent as the description thereof proceeds, the present invention provides a non-ridable machine for removing temporary tape that comprises:

a chassis or frame having front and rear wheels;

a vertical support post mounted on the frame or chassis between the front and rear wheels;

a horizontal arm mounted on the vertical support post;

a rotatable spool assembly attached to one end of the horizontal arm for winding used temporary tape thereon;

wherein the horizontal arm is rotatably coupled to the vertical support to allow the spool assembly to be positioned on either side of the chassis when the horizontal arm is rotated with respect to the vertical support post.

The present invention further provides a method of removing lane marking temporary tape from pavements which method comprises:

providing a non-ridable temporary tape removal machine that comprises:

a chassis or frame having front and rear wheels;

a vertical support post mounted on the frame or chassis between the front and rear wheels;

a horizontal arm mounted on the vertical support post;

a rotatable spool assembly attached to one end of the horizontal arm for winding used temporary tape thereon;

wherein the horizontal arm is rotatably coupled to the vertical support to allow the spool assembly to be positioned on either side of the chassis when the horizontal arm is rotated with respect to the vertical support post;

moving the non-ridable temporary tape removal machine along a pavement having a length of lane marking tape thereon; and pulling the temporary tape off the pavement by winding the tape onto the rotatable spool assembly.

BRIEF DESCRIPTION OF THE DRAWINGS

The present invention will be described with reference to the attached drawings which are given as non-limiting examples only, in which:

FIG. 2 is a left side perspective view of the temporary tape removal machine of FIG. 1.

FIG. 2A is a particle sectional view taken along section line 2A-2A in FIG. 2.

DETAILED DESCRIPTION OF THE DRAWINGS AND THE PRESENTLY PREFERRED EMBODIMENTS

Figure 1:
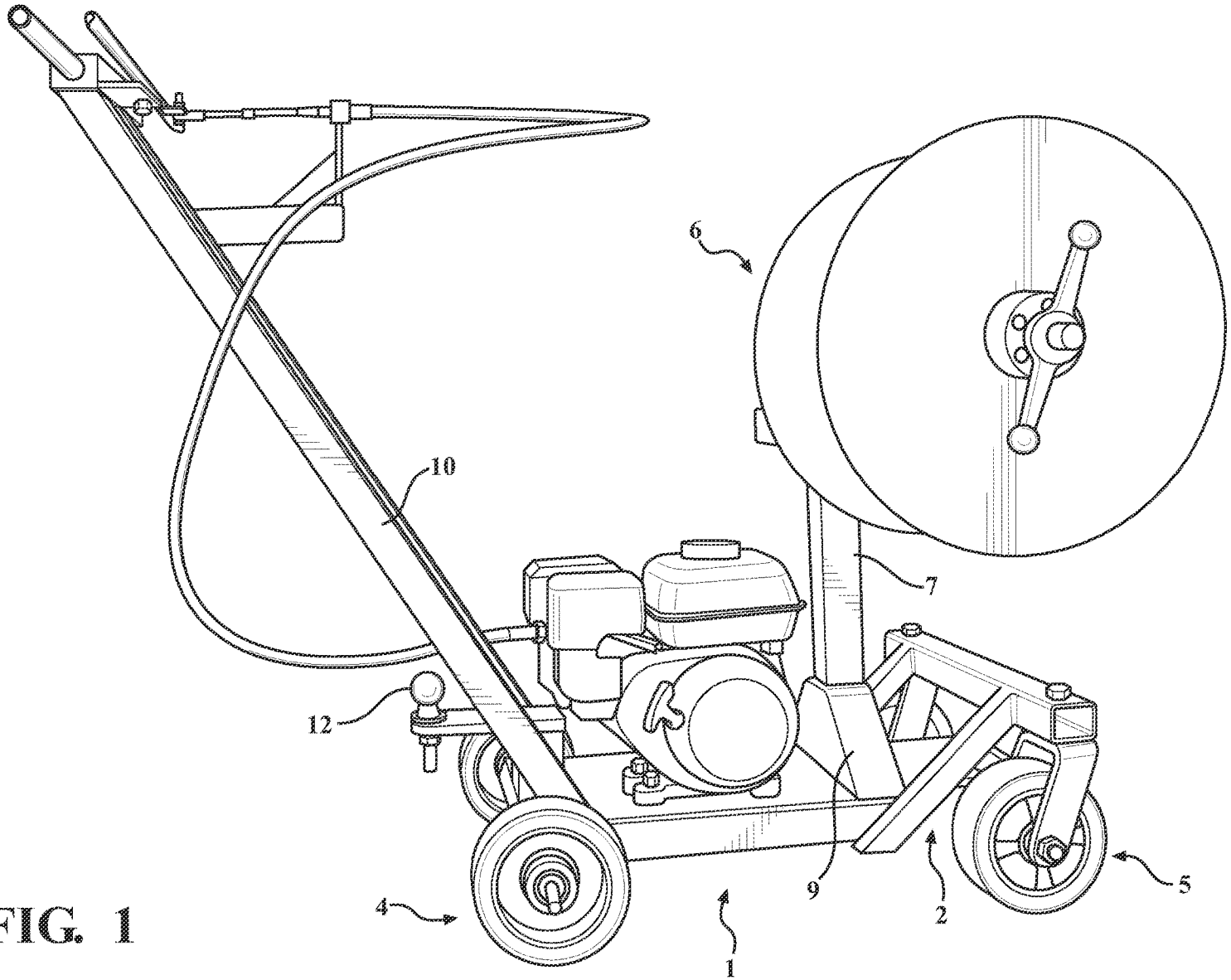
FIG. 1 is a right side view of a temporary tape removal machine according to one embodiment of the present invention.

The present invention provides temporary marking tape removal machines that are designed to be pushed by hand or towed or pushed by auxiliary devices. The temporary marking tape removal machines can be "non-ridable" in the sense that they are not designed for an operator to sit and ride on while driving the temporary marking tape removal machines. This reduces the overall size of the temporary marking tape removal machines. The temporary marking tape removal machines can further be "non-motorized" which as used herein means that the temporary marking tape removal machines do not include motors or engines that self-propel or drive the temporary marking tape removal machines. Otherwise, the temporary marking tape removal machines can include engines or motors to operate hydraulic pumps and drive rotatable spool assemblies as discussed below. It is to be understood that "non-ridable" temporary tape removal machines of the present invention can be self-propelled by including small engines that propel the non-ridable temporary tape removal machines, or hydraulic motors that function with the engine described below to drive the fixed wheels. Further, while non-ridable precludes a seat for an operator to sit and ride on, non-ridable does not exclude embodiments in which a operator can stand on the temporary tape removal machines during a tape removing operation or stand on a wheeled platform that is pulled by the temporary tape removal machines. However, the non-ridable temporary marking tape removal machines can only be guided and not sat on and rode by an operator. The non-motorized temporary marking tape removal machines can only be guided (if self-propelled), pushed by hand or towed or pushed by auxiliary devices. "Temporary marking tape removal machine(s)" or "temporary tape removal machine(s)" as used herein encompasses both non-ridable (in the sense of no provision for an operator to sit and ride) and non-motor driven as described above. The terms "temporary marking tape removal machine(s)" and "temporary tape removal machine(s)" are used interchangeable herein.

The temporary tape removal machines of the present invention are designed to remove temporary lane marking tape by rolling used, removed tape on a spool in much the same manner as described in U.S. Pat. Nos. 10,112,794; 10,926,969; and 10,907,313. The temporary tape removal machines of the present invention have been developed and designed for use at smaller construction sites than sites that are more suitable for the TRM of U.S. Pat. Nos. 10,112,794 and 10,926,969.

The temporary marking tape removal machines of the present invention include a rotatable spool assembly that can be the same as that taught in U.S. Pat. No. 10,112,794. The rotatable spool assembly can be supported on vertical post as described below or on a boom arm similar to that described in U.S. Pat. No. 10,112,794 or on a roller arm assembly similar to that described in U.S. Pat. No. 10,926,926. A hydraulic motor can be used to rotate the spool assembly as disclosed in these patents.

The temporary tape removal machines of the present invention also includes an engine that drives a hydraulic pump that controls the rotation of the spool assembly in a manner similar to that disclosed in of U.S. Pat. Nos. 10,112,794 and 10,926,969.

The vertical post or boom arm or roller arm assembly that supports the spool assembly and the engine and hydraulic pump that controls rotation of the spool assembly are mounted on a frame or chassis that is provided with front and rear wheels. According to one embodiment the front wheels can be swivel casters or coaster wheels and the rear wheels can be fixed axis wheels. Otherwise the rear wheels can be swivel casters or coaster wheels and the front wheels can be fixed axis wheels. These arrangements will allow the temporary tape removal machine to track in a straight direction and turn as desired during a tape removing operation. The diameter of the front and rear wheels can be chosen or the front and rear wheels can be attached to the frame or chassis to provide a desired clearance beneath the temporary tape removal machines that will lower the overall center of gravity.

The wheel base of the temporary tape removal machines is appreciable smaller than the MTRA disclosed in U.S. Pat. No. 10,112,794 which has a wheel base of about 54 inches. The wheel base of the present tape temporary tape removal machines can range from 28 to 34 inches, and the wheel track width can range from 22-28 inches. As described in more detail below, this relatively small wheel base and wheel track width requires a complicated overall design that can accommodate accumulations of removed, used temporary marking tape of up to 150 to 200 pounds on the rotatable spool assembly that can prevent catastrophic failure during a tape removing operation.

The length of the frame or chassis of the present temporary tape removal machines can be the same or slightly larger than the wheel base and the width of the frame of chassis can be the same or slightly smaller than the wheel track width with front or rear frame or chassis portions extending over swivel casters or coaster wheels. Portions of the frame or chassis that extend over the swivel casters or coater wheel can be higher than other portions of the frame or chassis so that the coaster wheels can be attached under these higher portions of the frame or chassis.

The frame or chassis can be formed from tubular elements or one or more bent metal plates or a combination of a bent metal plate with metal supporting/reinforcing elements where the swivel casters or coaster wheels and axis for the fixed wheels are attached to the frame or chassis.

While the small wheel base and wheel track width of the present temporary tape removal machines provide advantages of being able to remove temporary tape in tight areas, designing the temporary tape removal machines to remove up to 150 to 200 pounds of removed, used tape requires the overall design to depart significantly from the MTRA of U.S. Pat. Nos. 10,112,794 and 10,926,969. In the case of the MTRA of U.S. Pat. Nos. 10,112,794 and 10,926,969, the boom arm or roller arm assembly can be mounted on the chassis over or beyond the front wheels and the weight of the operator that counter balances the accumulated weight of removed tape wound on the spool assembly during a tape removal operation. Further, the larger footprint of the chassis helps stabilize the MTRA.

The present inventor has determined that in order to compensate for the smaller frame or chassis, wheel base and wheel track width of the temporary tape removal machines a number of design changes were required. The frame or chassis can be provided with additional weight or ballast close to surfaces that support the temporary tape removal machines during use. In addition, as discussed below, the spool assembly is provided on an end of a horizontal arm (at the top of a vertical support post) that can be provided with counter balance weight on the other end. Further, the vertical post or boom arm or roller arm assembly needs to be mounted on the frame or chassis between the front and rear wheels and extend vertically upward, as opposed to extending forward of the front wheels in the MTRA of U.S. Pat. Nos. 10,112,794 and 10,926,969.

According to some embodiments of the present invention the non-motorized tape removing machines are provided with a standard ball or other known hitch arrangements or structures near the rear so as to allow the temporary tape removal machines to be couple to and pushed by a conventional motorized ride-on attachment for propelling roadway equipment, such as Graco's LineDriver® HD Ride or Titan's LazyLiner Elite or similar devices.

FIG. 1 is a right side view of a temporary tape removal machine according to one embodiment of the present invention.

As shown in FIG. 1 the tape removal machine includes a frame or chassis 1 that in the embodiment shown has a peripheral square tubular frame 2 with a flat deck 3 secured thereon (See FIG. 2A). In the embodiment of the invention shown in FIG. 1 the rear wheels 4 are fixed and attached to an axis that extends beyond the sides of the frame or chassis 1. The front wheels 5 in the embodiment shown in FIG. 1 are swivel coasters or coaster wheels that are mounted to a portion of the frame or chassis 1 that is raised above the height of deck 3 with enough clearance to accommodate the swivel or coaster wheels 5.

In FIG. 1 the rotatable spool assembly 6 is positioned to extend beyond the right side of the frame or chassis 1. The rotatable spool assembly 6 is attached to one end of a horizontal arm 7 (See FIG. 2) that is rotatably coupled to the top of vertical post 8. As shown in FIG. 1 the bottom of vertical post 8 is providing with a bracing structure 9 that secures the vertical alignment of the vertical post 8.

A pair of risers 10 extent upwardly from the rear of the frame or chassis 1 and support a handle bar 11 at the top of the risers 10. Between the pair of risers 10 a standard ball hitch 12 is provided on the deck 3 so as to allow the temporary tape removal machine to be coupled to and pushed by a conventional motorized ride-on attachment for propelling roadway equipment as discussed above. The standard ball hitch 12 can be replaced with any other known structures/assemblies commonly used to tow or push non-motorized vehicles and/or wheeled devices.

An engine 13 is mounted on the deck 3 of the frame of chassis 1. The engine 13 is attached to and drives a counter rotating hydraulic pump 14 (See FIG. 2). Hydraulic hoses (not shown) connect the counter rotating hydraulic pump to a hydraulic motor 15 that drives the rotation of the rotatable spool assembly 6. Quick connect/disconnect couplers can be provided on the hydraulic hoses so that the hydraulic hoses can be easily disconnected from the hydraulic motor 15 to allow the rotatable spool assembly 6 to be moved from extending over one side of the frame or chassis 1 to extend over the other side of the frame or chassis 1 by rotating horizontal arm 7 about vertical post 8. Alternatively, the hydraulic lines can be connected to the counter rotating hydraulic pump 14 and/or hydraulic motor 15 by a rotatable connection that allows the hydraulic lines to be re-positioned without completely disconnecting the hydraulic lines when the rotatable spool assembly 6 is rotated about vertical post 8.

The horizontal arm 7 is coupled to the top of vertical post 8 via a rotatable connection 16 that can be provided by friction-reducing bushings provided on a machine or shoulder bolt that secures the horizontal arm 7 to the vertical post 8. Other rotatable connections can be used that include a turn tables as described in U.S. Pat. No. 10,926,969.

The top of the vertical post 8 includes a plate 17 that has locking pin receiving holes that allow the rotatable spool assembly 6 to be secured in position on either side of the tape removal machine or over the frame or cassis 1 (directed rearward) for transportation or storage. As shown in FIG. 2 the horizontal arm 7 includes a locking pin receiving projection 18 that includes a locking pin receiving hole that can be aligned with the locking pin receiving holes in the plate 17. Once the horizontal arm 7 is rotated to a desired position and the locking pin receiving hole in locking pin receiving projection 18 is aligned with one of the locking pin receiving holes in plate 17 a locking pin can be inserted into the aligned holes. According to one embodiment a spring biased locking pin can be used.

FIG. 2 is a left side view of the temporary tape removal machine of FIG. 1.

Figure 3:
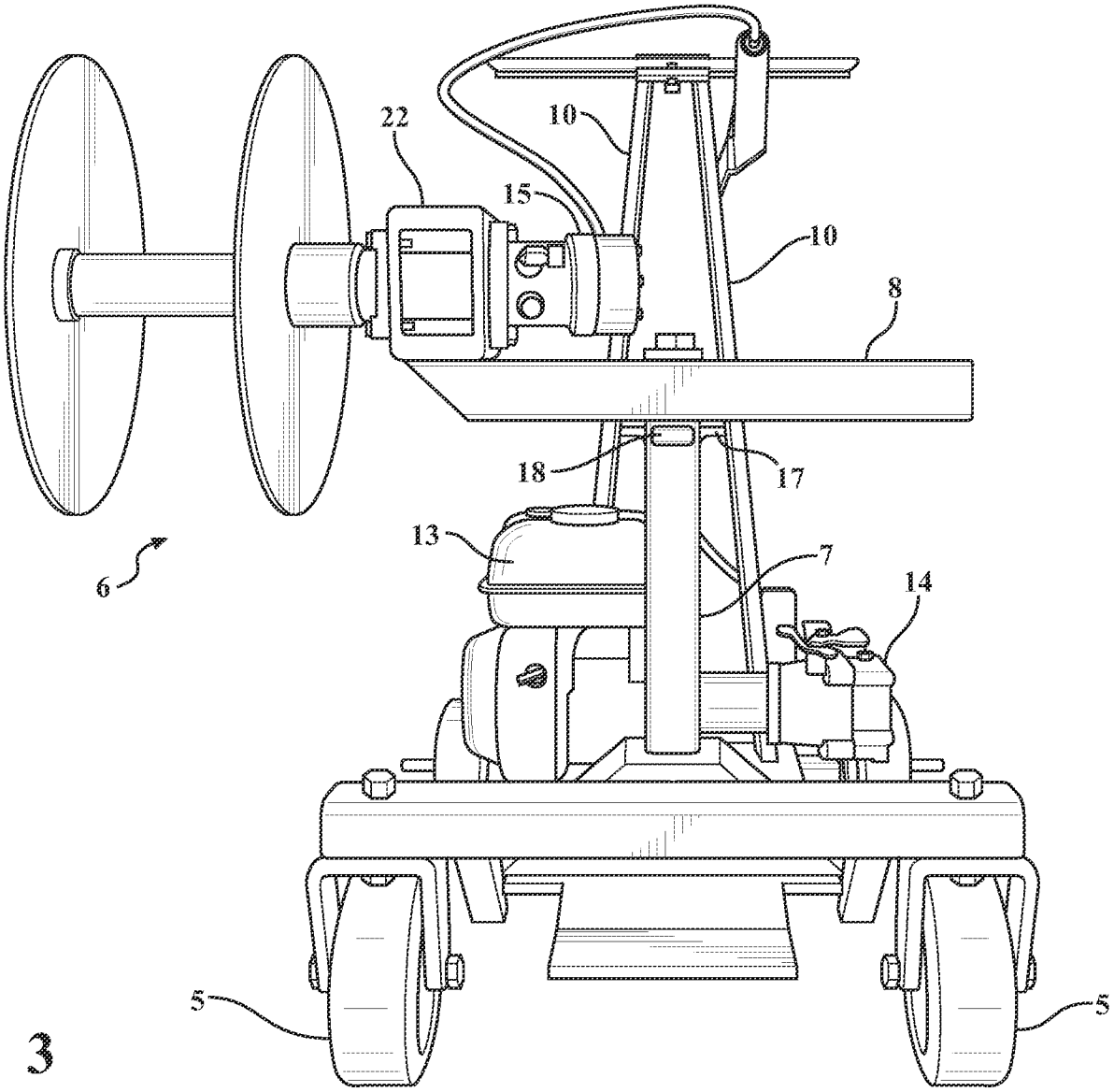
FIG. 3 is a front view of the temporary tape removal machine of FIG. 1.
Figure 5:
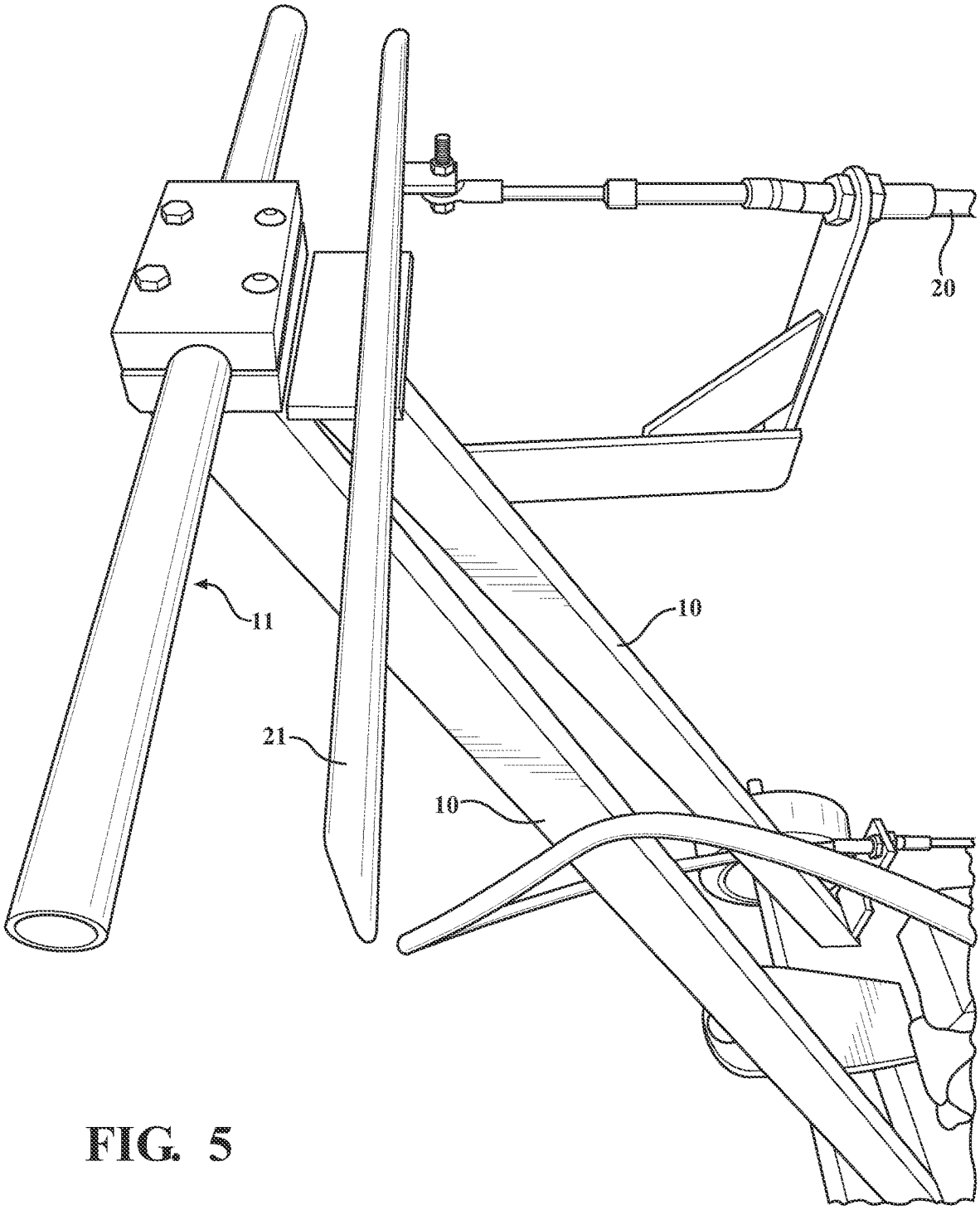
FIG. 5 is a view of a pivotal throttle bar that can be used to control the rotation of the rotatable spool assembly according to one embodiment of the present invention.

FIG. 2 shows the counter rotating hydraulic pump 14 attached to engine 13 and the linkage 19 and throttle cable 20 that operates the counter rotating hydraulic pump 14. The distal end of throttle cable 20 is attached a pivotal throttle bar 21 that is provided at the top of risers 10 as shown in FIGS. 1, 3 and 5. The throttle cable 20 can be pulled by pulling the left hand side of the throttle bar 21 or pushed by pulling the right hand side of the throttle bar 21.

The hydraulic motor 15 that drives the rotatable spool assembly 6 is show as being coupled to coupler body 22 which is described in U.S. Pat. No. 10,926,969. As shown in FIG. 2 the ball hitch 12 is provided in an elevated position on the deck 3 of the frame or chassis 1 as necessary for being coupled to and pushed by a conventional motorized ride-on attachment for propelling roadway equipment as discussed above.

FIG. 3 is a front view of the temporary tape removal machine of FIG. 1.

As shown in FIG. 3 the rotatable spool assembly 6 is similar to that described in U.S. Pat. No. 10,926,969 and includes a spool drive shaft, spool inner guard, spool bearing spacer, spool inner plate, disposable core or tape removal hub, spool outer guide 19, spool outer spacer, spool outer plate, and clamp handle—as described in U.S. Pat. No. 10,926,969.

Figure 4:
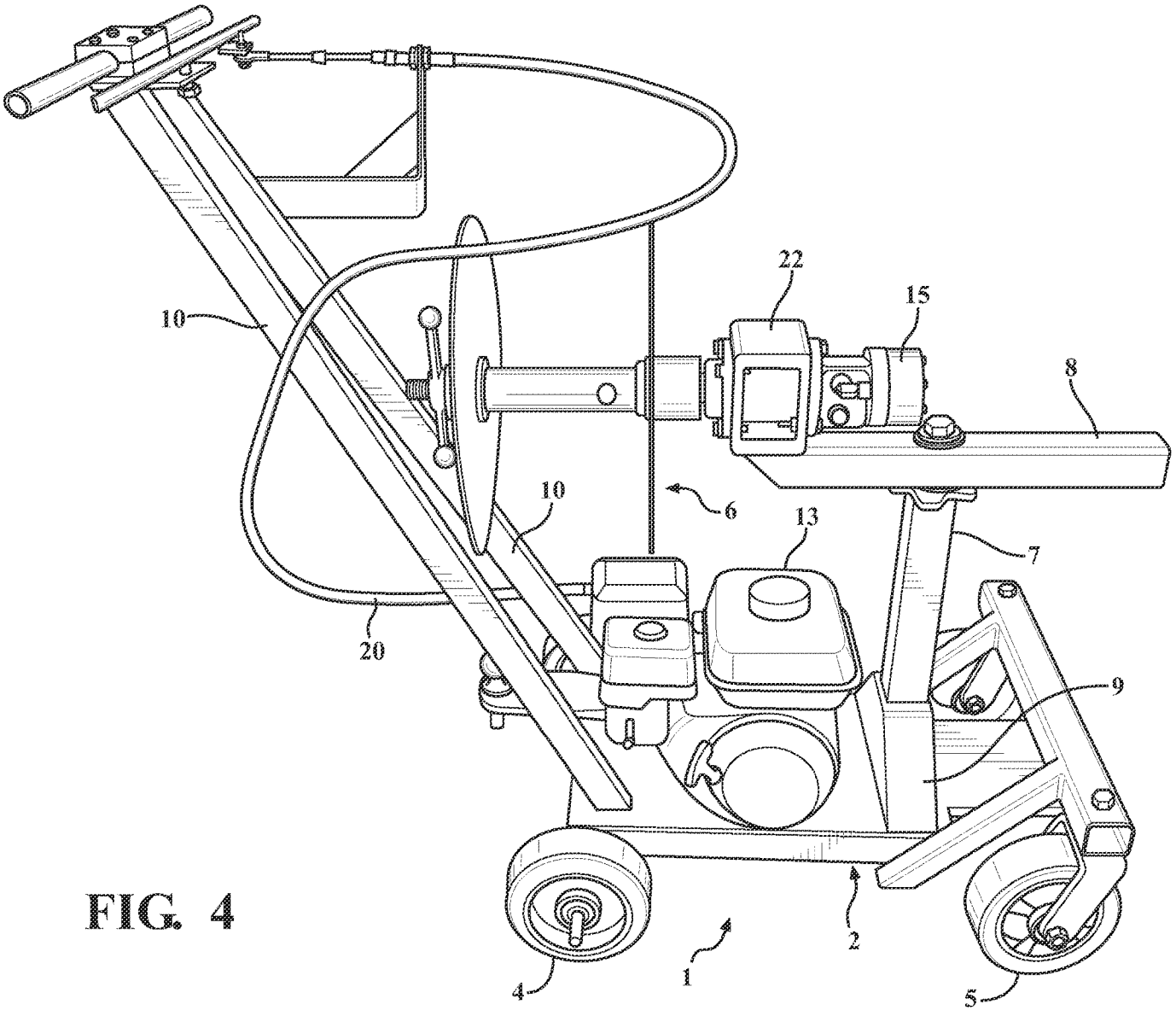
FIG. 4 is a right side view of a temporary tape removal machine of FIG. 1 showing the spool assembly in a stowed position.

FIG. 4 is a right side view of a temporary tape removal machine of FIG. 1 showing the spool assembly in a stowed position.

As can be understood from FIG. 4, the height of the vertical post 8 can be selected so that the horizontal arm 7 can be rotated to locate the rotatable spool assembly 6 over the engine 13 and counter rotating hydraulic pump 14.

FIG. 5 is a view of a pivotal throttle bar that can be used to control the rotation of the rotatable spool assembly according to one embodiment of the present invention.

As shown in FIG. 5 the distal end of the throttle cable 20 is attached to one side of the throttle bar 21. The throttle bar 21 is located in front of handle bar 11 so as to allow an operator to grasp both the handle bar 11 and throttle bar 21 and squeeze the throttle bar 21 toward the handle bar 11 causing the throttle bar 21 to pivot about the center of the throttle bar 21 and pull on the distal end of throttle cable 20. The handle bar 11 can also be used to guide the temporary tape removal machine during a temporary tape removal operation.

A further embodiment of a temporary tape removal machine will be described with reference to FIGS. 6-8. In this embodiment the frame or chassis is formed from a metal plate that is cut and bent rather than being formed from welded tubular elements having a separate deck attached thereto. The embodiment of the temporary tape removal machine show in FIGS. 6-8 reduces manufacturing costs and provides front area of the deck where a container for storing a supply of disposable cores or tape removal hubs.

Figure 6:
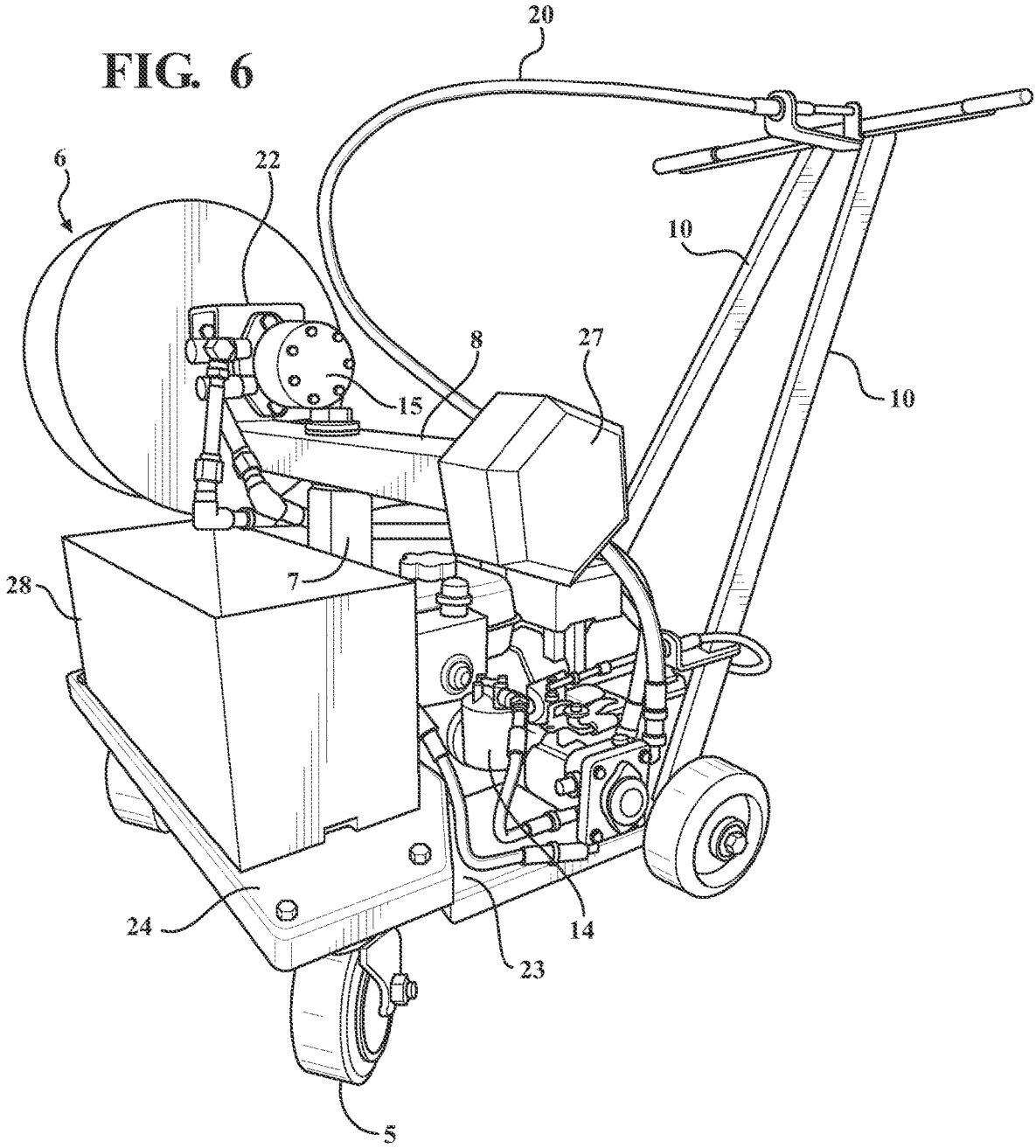
FIG. 6 is a left side perspective view of a temporary tape removal machine according to another embodiment of the present invention.
Figure 7:
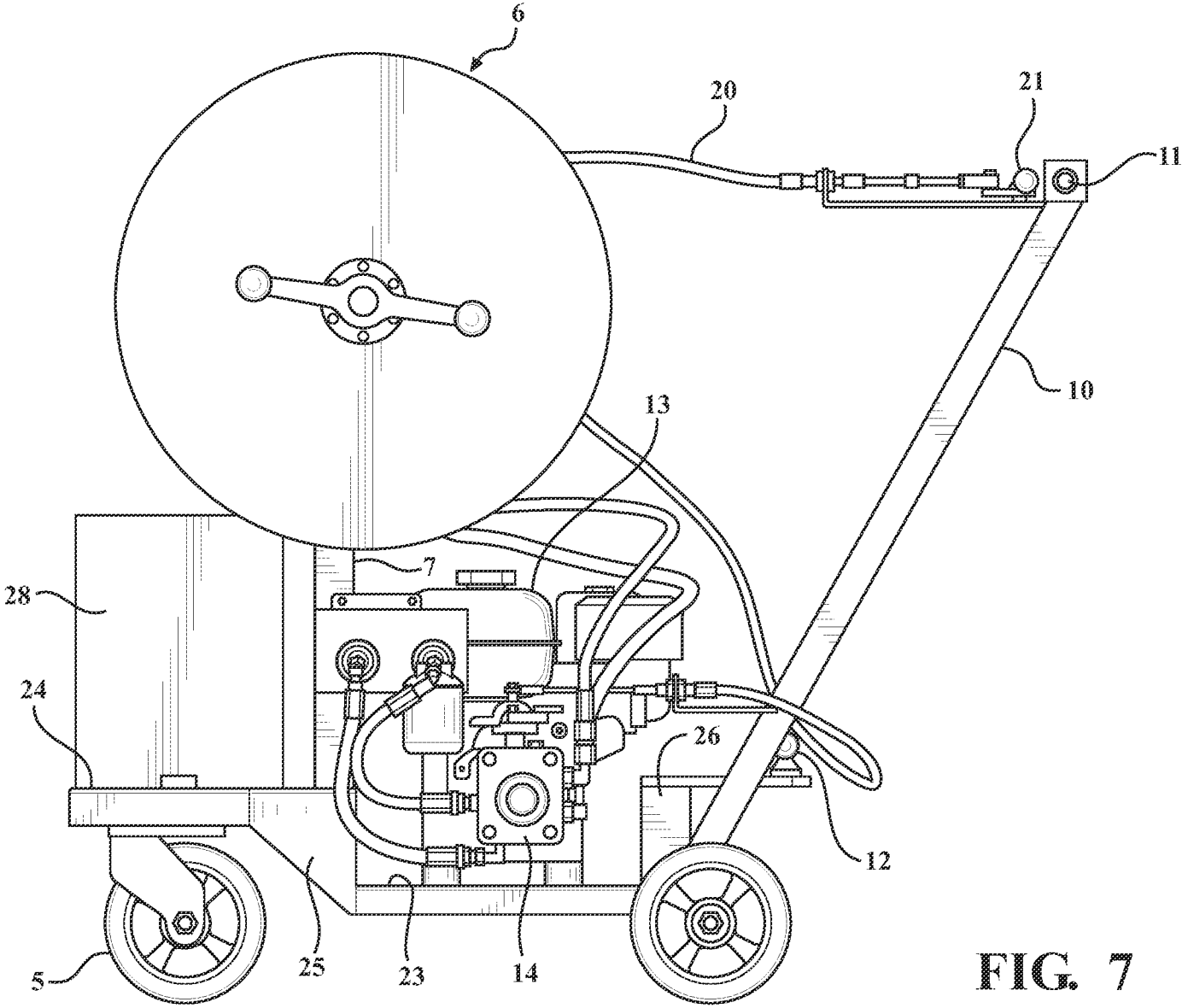
FIG. 7 is a left side planar view of the temporary tape removal machine of FIG. 6.

The temporary tape removal machine shown in FIGS. 6 and 7 does not include the engine or counter rotating hydraulic pump so as to better show the deck which is formed from a bent metal plate.

FIG. 6 is a left side perspective view of a temporary tape removal machine according to another embodiment of the present invention. FIG. 7 is a left side planar view of the temporary tape removal machine of FIG. 6.

The temporary tape removing machine of FIG. 6 has a lower main deck area 23 and a higher front deck area 24 that are each formed from one or more bent metal plates. The higher front deck area 24 is elevated at a height that allows swivel coasters or coaster wheels 5 to be positioned under the higher front deck area 24 as shown. In an alternative embodiment, in which swivel coasters or coaster wheels 5 can be provided as the rear wheels of the temporary tape removal machine and the rear portion of the deck area 23 could be higher than the front deck area 24 or both could be high enough to accommodate the swivel coasters or coaster wheels 5. One advantage of having the lower main deck area 23 lower as shown in FIGS. 6 and 7 is that the weight of the engine 13 and counter rotating hydraulic pump 14 would be at a lower position to help counter balance the weight of removed tape taken up on the spool assembly 6. If necessary or desired, ballast weight could be added to or provide below the deck 3.

In the embodiment of the temporary tape removal machine of FIG. 6 the bottom of the vertical post 7 is attached to a portion of the lower main deck area 23 and extends beneath the higher front deck area 24. After the vertical post 7 is attached to the lower main deck area 23 a bent metal plate forming the higher front deck area 24 can be dropped down over the vertical post 7 and welded to the lower main deck area 23. Triangular side plates 25 are welded to the sides of the higher front deck area 24 and the lower main deck area 23 as shown.

At the back of the lower main deck area 23 has a raised hitch support 26 to which a standard ball hitch 12 as discussed above in reference to FIG. 1 can be mounted. Alternatively, any other known structures/assemblies commonly used to tow or push non-motorized vehicles and/or wheeled devices can be provided on the raised hitch support 26.

The horizontal arm 8 in FIG. 6 is similar to that discussed above in reference to FIG. 1. In FIG. 6 the horizontal arm 8 is positioned to extend beyond the right side of the temporary tape removal machine. A counter balance weight 27 is provided on the opposite side of the horizontal arm 8 as shown in FIG. 6. Counter balance weights 27 having different masses can interchanged depending on the mass of removed temporary tape that is to be removed from a surface and wound on the spool assembly 6. The horizontal arm 8 can be hollow and the counter balance weights 27 can be provided with a shaft that can be inserted into the hollow horizontal arm 8 and secured by a pin that can be inserted in aligned pin holes in the horizontal arm 8 and shafts on the counter balance weights 27.

As shown in FIG. 6, the spool assembly 6 is attached to coupler body 22 and includes those elements discussed above and described in U.S. Pat. No. 10,926,969, including a spool drive shaft, spool inner guard, spool bearing spacer, spool inner plate, disposable core or tape removal hub, spool outer guide 19, spool outer spacer, spool outer plate, and clamp handle as described in U.S. Pat. No. 10,926,969.

As shown in FIGS. 6 and 7 a container 28 for storing a supply of disposable cores or tape removal hubs is provided on the higher front deck area 24 in front of the vertical post 7. The container 28 preferably has a height that is low enough to allow the horizontal arm 8 supporting the spool assembly 6 to pass over the container 28*n* when the support arm 8 is rotated and reposition with respect to the vertical post 7.

Figure 8:
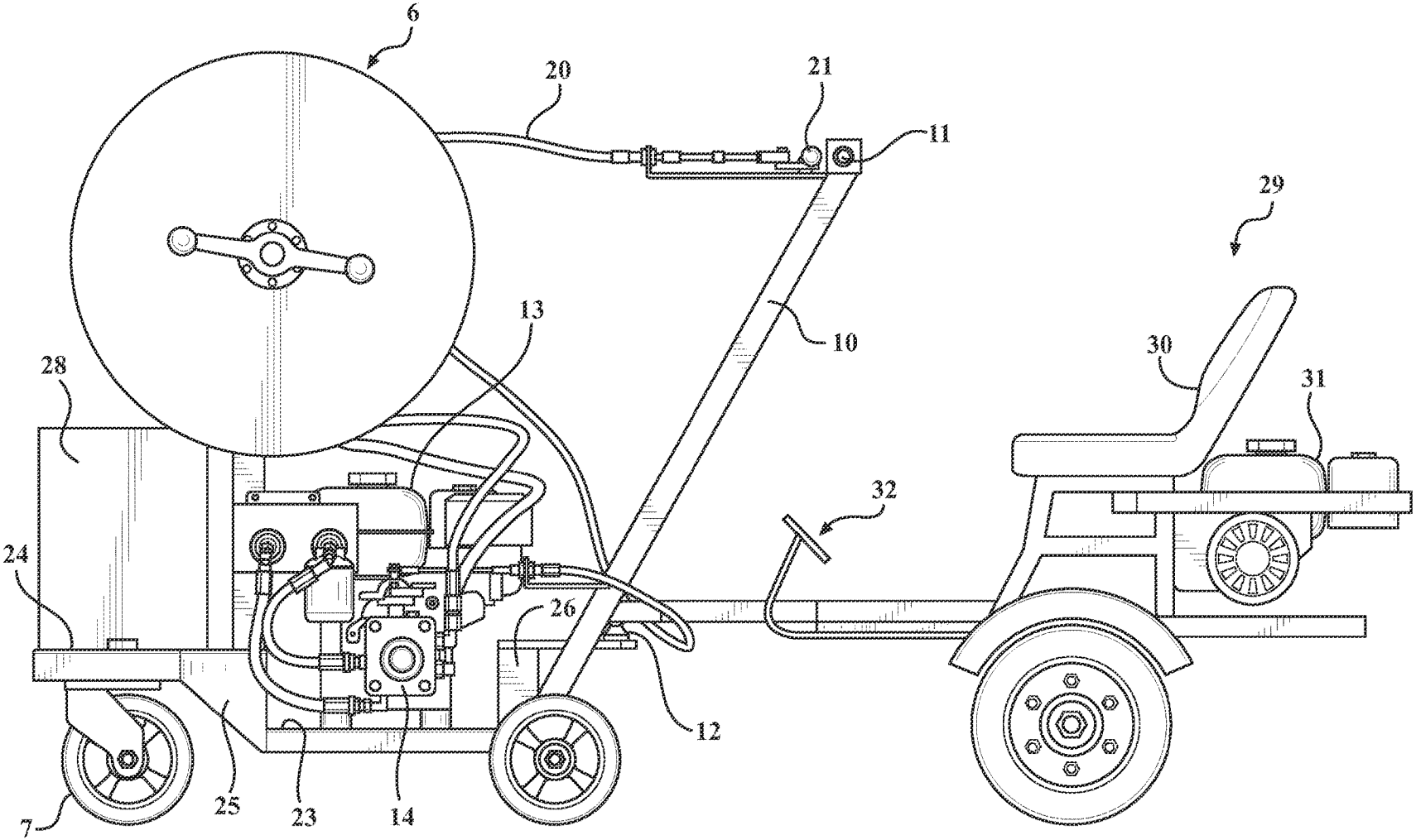
FIG. 8 is a side view of the temporary tape removal machine of FIG. 6 having an auxiliary, ride-on, pushing device coupled thereto.

FIG. 8 is a side view of the temporary tape removal machine of FIG. 6 having an auxiliary, ride-on, pushing device couple thereto.

As discussed above, the temporary tape removal machines of the present invention are non-ridable in the sense that they do not include a seat for an operator to sit and rind on. The temporary tape removal machines can be self-propelled as discussed above and guided. Otherwise the temporary tape removal machines can be guided and/or pushed by hand or towed or pushed by auxiliary devices. FIG. 8 shows and embodiment in which an auxiliary, ride-on pushing device 29 is coupled thereto the standard ball 12 or other known hitch arrangement or structure provided on the raised hitch support 26.

The auxiliary, ride-on pushing device 29 includes a seat 30, engine 31 and speed control and braking pedals 32 or other throttle and breaking controls. The direction of the coupled temporary tape removal machine is controlled by the operator using the handle bar 11.

Figure 9:
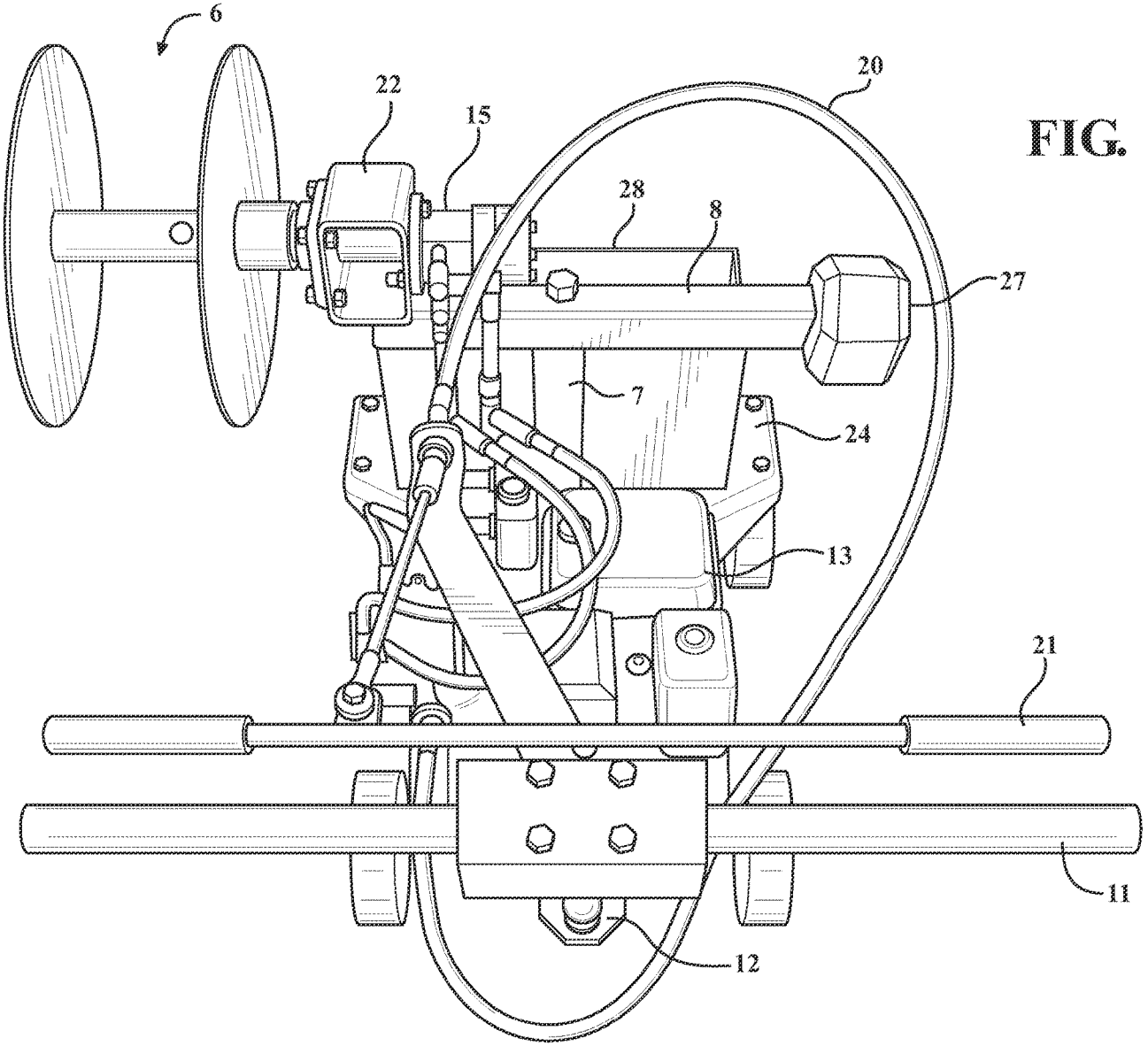
FIG. 9 is a rear upper perspective view of the tape removal machine of FIG. 6.

FIG. 9 is a rear upper perspective view of the tape removal machine of FIG. 6. As shown in FIG. 9 the distal end of the throttle cable 20 is attached to one side of the throttle bar 21. The throttle bar 21 is located in front of handle bar 11 so as to allow an operator to grasp both the handle bar 11 and throttle bar 21 and squeeze the throttle bar 21 toward the handle bar 11 causing the throttle bar 21 to pivot about the center of the throttle bar 21 and pull on the distal end of throttle cable 20. The handle bar 11 can also be used to guide the temporary tape removal machine during a temporary tape removal operation.

In FIG. 9 the rotatable spool assembly 6 is position over the left side of the temporary tape removal machine and the counter balance weight 27 extends over the right side of the temporary tape removal machine. The coupler body 22 and hydraulic motor 15 are mounted on the top of horizonal arm 8.

Other features of the temporary tape removal machines include a core caddy similar to that disclosed in U.S. Pat. No. 10,112,794 that is used to store disposable cores or the tape removal hubs of U.S. Pat. No. 10,907,313 and U.S. Non-provisional patent application Ser. No. 17/094,898. Such a core caddy can be provided on the frame or chassis in any convenient location.

Another feature that can be included in the temporary tape removal machines is a holder provided at a convenient location to hold a spray bottle of a lubricant that can be sprayed on the discs of the spool assembly to prevent the removed, used temporary tape from sticking to the discs.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above and set forth in the attached claims.

The invention claimed is:

1. A non-ridable machine for removing temporary tape that comprises:

a chassis or frame having front and rear wheels;

a vertical support post mounted on the frame or chassis between the front and rear wheels;

a horizontal arm mounted on the vertical support post;

a rotatable spool assembly attached to one end of the horizontal arm for winding used temporary tape thereon;

means to rotate the rotatable spool assembly;

wherein the horizontal arm is rotatably coupled to the vertical support to allow the spool assembly to be positioned on either side of the chassis when the horizontal arm is rotated with respect to the vertical support post.

2. A non-ridable machine for removing temporary tape according to claim 1, further comprising a counter balance weight on an end of the horizontal arm that is opposite to the end to which the rotating spool assembly is attached.

3. A non-ridable machine for removing temporary tape according to claim 1, wherein the non-ridable machine comprises a hitch provided on a rear portion of the frame or chassis for coupling the non-ridable machine to an auxiliary motorized ride-on device for pushing the non-ridable machine during a temporary tape removal operation.

4. A non-ridable machine for removing temporary tape according to claim 1, wherein the horizontal arm is selectively lockable in a position over a right side of the frame or chassis, a position over a left side of the frame or chassis or a rearward directed position for storage or transport.

5. A non-ridable machine for removing temporary tape according to claim 4, wherein the vertical support has a plate attached to the top that includes a plurality of pin receiving hole and the horizontal arm includes locking pin receiving projection having a pin receiving hole.

6. A non-ridable machine for removing temporary tape according to claim 1, wherein the front wheels are swivel coaster or coaster wheels and the rear wheels are fixed axis wheels.

7. A non-ridable machine for removing temporary tape according to claim 1, wherein the rear wheels are swivel coaster or coaster wheels and the front wheels are fixed axis wheels.

8. A non-ridable machine for removing temporary tape according to claim 1, further comprising a pair of risers that extend upwardly from the rear of the frame or chassis with a handle bar attached to upper ends of the pair of risers.

9. A non-ridable machine for removing temporary tape according to claim 1, further comprising an engine and a hydraulic pump mounted on the frame or chassis and a hydraulic motor coupled to the rotatable spool assembly for driving rotation of the rotatable spool assembly.

10. A non-ridable machine for removing temporary tape according to claim 9, further comprising a throttle controller for controlling the hydraulic pump.

11. A non-ridable machine for removing temporary tape according to claim 10, wherein the throttle controller is provided at the top of a pair of risers that extend upwardly from the rear of the frame or chassis.

12. A non-ridable machine for removing temporary tape according to claim 1, further comprising ballast weight attached to the frame or chassis.

13. A method of removing lane marking temporary tape from pavements which method comprises:

providing a non-ridable temporary tape removal machine that comprises:

a chassis or frame having front and rear wheels;

a vertical support post mounted on the frame or chassis between the front and rear wheels;

a horizontal arm mounted on the vertical support post;

a rotatable spool assembly attached to one end of the horizontal arm for winding used temporary tape thereon;

means for rotating the rotatable spool assembly;

wherein the horizontal arm is rotatably coupled to the vertical support to allow the spool assembly to be positioned on either side of the chassis when the horizontal arm is rotated with respect to the vertical support post;

moving the non-ridable temporary tape removal machine along a pavement having a length of lane marking tape thereon; and pulling the temporary tape off the pavement by winding the tape onto the rotatable spool assembly.

14. A method of removing lane marking temporary tape from pavements according to claim 13, wherein the non-ridable temporary tape removal machine is manually guided along the pavement by hand.

15. A method of removing lane marking temporary tape from pavements according to claim 13, wherein the non-ridable temporary tape removal machine is non-motorized and is pushed along the pavement by an auxiliary motorized device.

16. A method of removing lane marking temporary tape from pavements according to claim 15, wherein the auxiliary motorized device comprises a ride-on device.

17. A method of removing lane marking temporary tape from pavements according to claim 13, wherein the removed tape is wound up on a disposable core member that is removably provided on the rotatable spool assembly.

18. A method of removing lane marking temporary tape from pavements according to claim 13, further comprising providing a counter balance weight on an end of the horizontal arm that is opposite to the end to which the rotating spool assembly is attached.

19. A method of removing lane marking temporary tape from pavements according to claim 13, wherein the front wheels comprise swivel coasters or coaster wheels.

20. A method of removing lane marking temporary tape from pavements according to claim 13, wherein at least one of the rotational speed of the rotatable spool assembly or speed of moving the non-motorized temporary tape removal machine along a pavement is controlled to control the force applied to pull the lane marking tape off the pavement.

* * * * *